US012049798B2

(12) United States Patent
D'Souza et al.

(10) Patent No.: US 12,049,798 B2
(45) Date of Patent: Jul. 30, 2024

(54) AUTONOMOUS SUBSEA TIEBACK ENABLING PLATFORM

(71) Applicants: Richard B. D'Souza, Salt Lake City, UT (US); Brian Curtis Jarrell, Magnolia, TX (US); David Brian Anderson, Houston, TX (US); Bambang Abimanju Sarwono, Houston, TX (US)

(72) Inventors: Richard B. D'Souza, Salt Lake City, UT (US); Brian Curtis Jarrell, Magnolia, TX (US); David Brian Anderson, Houston, TX (US); Bambang Abimanju Sarwono, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 0 days.

(21) Appl. No.: 17/458,999

(22) Filed: Aug. 27, 2021

(65) Prior Publication Data

US 2022/0065064 A1 Mar. 3, 2022

Related U.S. Application Data

(60) Provisional application No. 63/070,826, filed on Aug. 27, 2020.

(51) Int. Cl.
*E21B 33/035* (2006.01)
*B63B 3/48* (2006.01)
(Continued)

(52) U.S. Cl.
CPC ..... *E21B 33/0355* (2013.01); *B63B 3/48* (2013.01); *B63B 21/26* (2013.01); *B63B 21/50* (2013.01);
(Continued)

(58) Field of Classification Search
CPC ..... E21B 33/0355; E21B 43/0107; E21B 43/017; B63B 3/48; B63B 21/26; B63B 21/50; B63B 35/4413
(Continued)

(56) References Cited

U.S. PATENT DOCUMENTS 5,114,117 A * 5/1992 Appleford ..... F16L 37/367 166/341
2002/0044838 A1* 4/2002 Amin ..... B63B 22/24 405/224.2
(Continued)

OTHER PUBLICATIONS

PCT, International Search Report and Written Opinion mailed Dec. 14, 2021 for International Application No. PCT/US2021/047888 filed Aug. 27, 2021 (18 pages).

*Primary Examiner* — Matthew R Buck
*Assistant Examiner* — Patrick F Lambe
(74) *Attorney, Agent, or Firm* — Gary M. Machetta

(57) ABSTRACT

A system for conveying a fluid produced from at least one producing subsea well to an existing host facility via a flowline includes a support structure having at least a deck, a mooring system, and a plurality of topsides modules. The mooring system anchors the support structure to a seabed and passively positions the support structure proximate to the at least one producing subsea well. The support structure elevates the deck above a water's surface and is normally unmanned. The plurality of topsides modules are disposed on the deck. The topsides modules include at least: a power generation module; a switchgear module a flowline heating module; a chemical injection module; a water injection module; a subsea control module; and a control module that communicates with a remote command center.

20 Claims, 4 Drawing Sheets

(51) Int. Cl.

| | |
|---|---|
| ***B63B 21/26*** | (2006.01) |
| ***B63B 21/50*** | (2006.01) |
| ***B63B 35/44*** | (2006.01) |
| ***E21B 43/01*** | (2006.01) |
| ***E21B 43/017*** | (2006.01) |

(52) U.S. Cl.
CPC ..... *B63B 35/4413* (2013.01); *E21B 43/0107* (2013.01); *E21B 43/017* (2013.01)

(58) Field of Classification Search
USPC ..... 166/352
See application file for complete search history.

(56) References Cited

U.S. PATENT DOCUMENTS

| | | | | |
|---|---|---|---|---|
| 2004/0149446 | A1* | 8/2004 | Appleford | H01R 13/523 166/368 |
| 2008/0210433 | A1 | 9/2008 | Bhat et al. | |
| 2008/0267716 | A1 | 10/2008 | D'Souza et al. | |
| 2012/0085544 | A1 | 4/2012 | Shilling et al. | |
| 2013/0277060 | A1* | 10/2013 | Critsinelis | E21B 33/035 166/345 |
| 2015/0060138 | A1* | 3/2015 | Vandenworm | E21B 7/12 175/8 |
| 2015/0075216 | A1* | 3/2015 | Van Wijngaarden | B63B 73/40 62/611 |
| 2017/0204704 | A1 | 7/2017 | Sommerfield et al. | |
| 2022/0174918 | A1* | 6/2022 | Fitzgerald | A01K 61/10 |
| 2022/0289345 | A1* | 9/2022 | Pedersen | B63B 1/107 |

* cited by examiner

AUTONOMOUS SUBSEA TIEBACK ENABLING PLATFORM

CROSS REFERENCE TO RELATED APPLICATIONS

This application claims priority from U.S. Provisional Application Ser. No. 63/070,826 filed on Aug. 27, 2020, the entire disclosure of which is incorporated herein by reference in its entirety.

BACKGROUND

1. Technical Field

Embodiments described herein generally relate to systems and methods for autonomously powering, injecting water and/or chemicals, boosting, and providing active thermal management of produced fluids to an existing processing and export platform from a location proximate to a subsea well or wells.

2. Description of the Related Art

A subsea tieback generally refers to an engineering strategy wherein an offshore hydrocarbon reservoir, or satellite field, is connected to an existing production facility, or "host facility." Connecting one or more satellite fields to an existing production facility using one or more flowlines eliminates the need to construct new production structures and significantly reduces the capital expenditure required to develop these satellite fields. However, utilizing subsea tiebacks for an oil reservoir in water depths greater than 300 meters can be constrained by a number of factors. For instance, conventional subsea tieback strategies cannot always be applied to step out distances over 30 km from the host facility due to technical limitations and high cost. Also, subsea wells often require machinery and supplies to support efficient hydrocarbon production. Existing host facilities may have insufficient topsides space and weight availability to accommodate such machinery and supplies, especially if multiple subsea wells are required. Also, some remote fields may require waterflood to obtain sufficient reservoir recovery to ensure commercial viability, which may not be feasible with currently available host facilities.

In certain aspects, the present disclosure addresses the need to facilitate commercial exploitation of subsea tiebacks to existing host facilities that are distant from a subsea well or wells.

SUMMARY

In aspects, the present disclosure provides a system for conveying a fluid produced from at least one producing subsea well to an existing host facility within a 100 km distance via a flowline. The system may include a support structure having at least a deck, a mooring system, and a plurality of topsides modules. The mooring system anchors the support structure to a seabed and passively positions the support structure proximate to the at least one producing subsea well. The support structure elevates the deck above a water's surface.

The plurality of topsides modules are disposed on the deck. The topsides modules include at least: a power generation module configured to generate electrical power; a switchgear module configured to boost the flow from at least one fluid mover, at least one flow control device, and at least one thermal unit; a flowline heating module configured to energize a heating unit associated with the flowline; a chemical injection module configured to add at least one additive to the fluid produced from the at least one producing subsea well; a water injection module to treat, compress and inject seawater to at least one injection well associated with the at least one producing subsea well to improve ultimate resource recovery from the reservoir; a subsea control module configured to control at least one producing subsea well device; and a control module configured to communicate with a remote command center.

In aspects, a related method may include positioning the support structure at a water's surface and proximate to the at least one producing subsea well. The method may include the further steps of: heating the produced fluid in the flowline using at least the power generation module, the flow line heating module, and the switchgear module; injecting the at least one additive into the at least one producing subsea well using the chemical injection module; treating, compressing, and injecting seawater into the at least one injection wells using the water injection module; controlling at least one producing subsea well device using the subsea control module; and communicating with the remote command center using the control module.

It should be understood that examples of certain features of the disclosure have been summarized rather broadly in order that the detailed description thereof that follows may be better understood, and in order that the contributions to the art may be appreciated. There are, of course, additional features of the disclosure that will be described hereinafter and which will in some cases form the subject of the claims appended thereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION

In aspects, the present disclosure provides a tieback enabling platform that is configured to support a long subsea tieback. By "long," it meant at least thirty kilometers between the tieback enabling platform and a host facility. In embodiments, the tieback enabling platform may be an autonomous, spread-moored semi-submersible platform that is moored adjacent to one or more producing subsea wells. The tieback enabling platform is configured to perform all required production and flow control at the satellite field. The tieback from the satellite field to the host facility conveys produced reservoir fluids. The host facility only needs to process the reservoir fluid and export the processed fluids to a pipeline network.

In embodiments, the tieback enabling platform includes equipment and systems to perform topsides functions needed for power generation, well control, mudline boosting, chemical storage and injection, active thermal management and water injection. The tieback enabling platform can extend the range of subsea tiebacks to a host facility from 30 km to over 100 km. Among the advantages of tieback enabling platforms according to the present disclosure are the elimination of long, costly power and control umbilicals from the host facility to the producing subsea wells. Furthermore, embodiments of the tieback enabling platform may be unmanned, thereby saving significant capital and operating costs otherwise required to enable human control.

Figure 1:
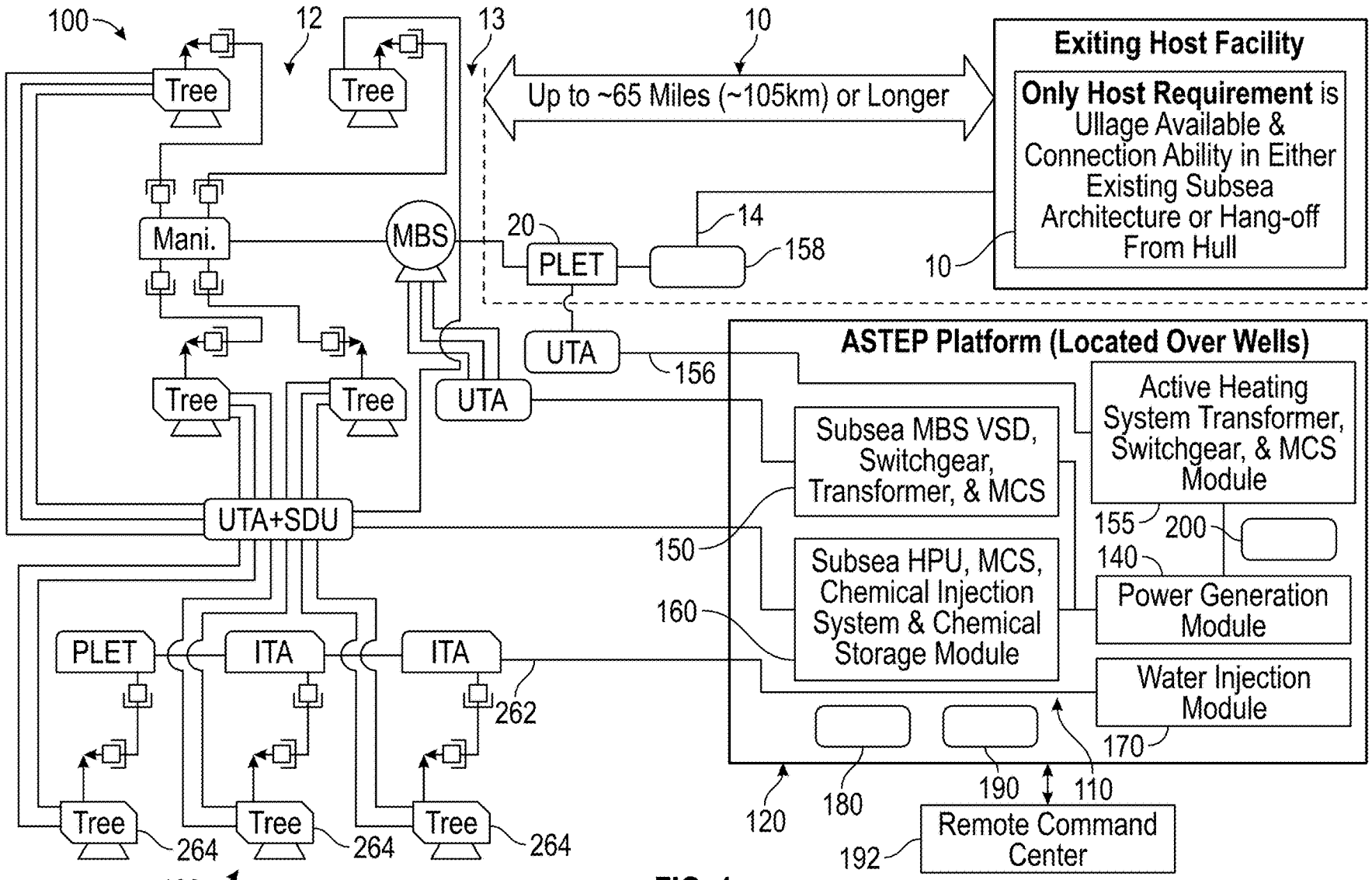
FIG. 1 schematically illustrates an embodiment of a subsea tieback enabling platform according to the present disclosure incorporated within a subsea field serviced by a host facility.
Figure 2:
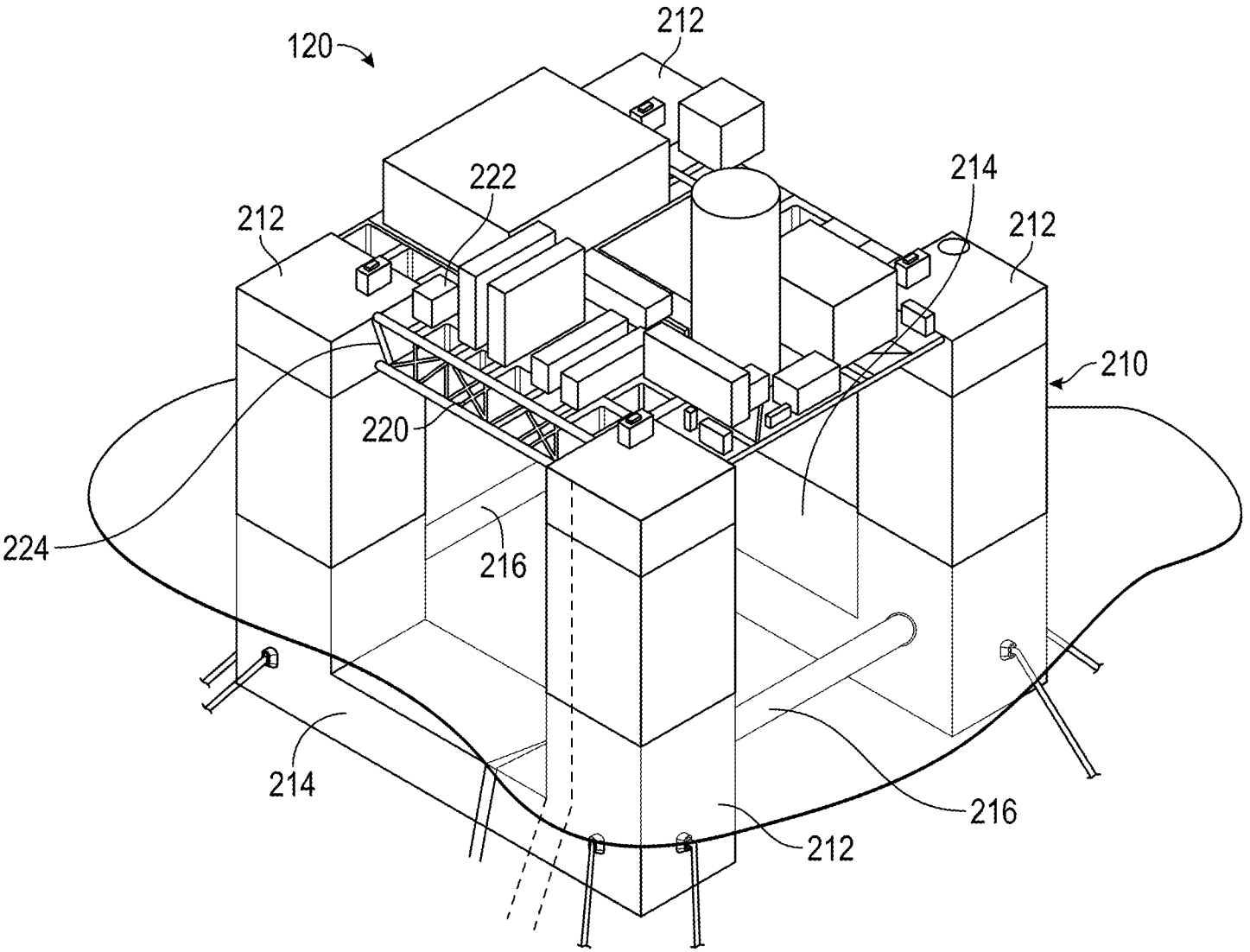
FIG. 2 depicts an isometric view of a subsea tieback enabling support structure according to one embodiment of the present disclosure.

Referring to FIG. 1, there is schematically illustrated one non-limiting embodiment of a tieback enabling platform 100 according to the present disclosure that may be incorporated into an offshore field requiring a tieback to a host facility 10. The offshore field may have one or more producing subsea wells 12 and a subsea flowline 14 that conveys produced fluids to the host facility 10. Tieback enabling platforms 100 according to the present disclosure can extend the length of the subsea tieback 14 from 30 km to over 100 km. As described in greater detail below, the tieback enabling platform 100 may include a topsides 110 and a support structure 120 (FIG. 2).

The topsides 110 includes systems, supplies, and any other equipment required to service the producing subsea wells 12. One illustrative, but not limiting, embodiment of the topsides 110 may include a power generation module 140, a switchgear module 150, a flowline heating module 155, a chemical injection module 160, a water injection module 170, a subsea control module 180, a control module 190, and a general utility module 200. Each of these modules is discussed in further detail below.

The power generation module 140 generates the power used to energize the equipment on the tieback enabling platform 100. In one embodiment, the power generation module 140 may be configured to generate up to 20 MW of power by using one or more diesel electric, air-cooled generator sets. Illustrative consumers for this power include two 3 MW subsea mudline booster pumps, which can provide 6 MW of continuous active flowline thermal management and 6 MW of power to subsea booster pumps. In one embodiment, this power could be supplied via a high voltage electric cable from onshore or a proximate platform. In this embodiment the power generation module would consist of transformers to convert the high voltage power to low voltage power. Such a configuration is estimated to enable enhanced recovery and flow rates up to 60,000 BOEPD of reservoir fluids, over a distance of 100 km or greater, to a host facility.

The switchgear modules 150 and 155 may include electrical switchgears for managing the flow of produced fluid from the producing subsea wells 12 to the host facility 10. This fluid flow may be controlled using fluid movers such as pumps, flow control devices such as valves, and thermal units such as flow line heaters. For example, the switchgear modules 150 and 155 may be configured to drive subsea mudline boosting pumps (not shown) and energize an active thermal management system 158 of the subsea tieback 14 to prevent wax or hydrate blockages during normal and transient operations. In one embodiment, the switchgear modules 150 and 155 may be configured as two sets of two forty-foot containers. The first set will contain the variable speed drives, associated switchgear, and HVAC required to power and control the mudline pumps. The second set will contain the transformers and switchgear to control the flowline active thermal management system. Each container may be self-contained and designed to require minimal hook up during assembly and integration on the deck.

The flowline heating module 155 may include a transformer, switchgear, and MCS module that is connected by one or more umbilicals 156 to a pipeline end termination 20.

The chemical injection module 160 may be configured to store and inject additives to inhibit hydrate, wax, corrosion, scale and/or asphaltene in the flowlines conveying the reservoir fluids. The additives may be injected into the well, at the wellhead, or at any location along a flowline connected to the wellhead. These additives may be stored in totes or dedicated tanks and placed on the deck. In embodiments, the totes and tanks may be sized to store sufficient additives for two months of injection for up to eight producing subsea wells without resupply.

The water injection module 170 is configured to provide treatment, compression and injection of seawater to improve ultimate resource recovery from a reservoir. The tieback enabling platform 100 may be configured to accommodate a 75,000 BWPD water injection module with seawater lift pumps, de-aeration, treatment and compression equipment. In one illustrative non-limiting embodiment, the subsea field 130 may include one or more injection wells 264 that have been drilled to flood a hydrocarbon reservoir with an injection fluid such as water. In a conventional manner, water injected into the injection wells 264 create a water front that displaces hydrocarbons toward the producing subsea wells 12.

The subsea control module 180 may be configured to house one or more hydraulic power units and equipment for producing subsea well control functions. The producing subsea well control functions may be performed by producing subsea well devices such as production control valves, etc.

The control module 190 may be configured to provides realtime bidirectional signal transfer between the tieback enabling platform 100 and a remote command center 192. The tieback enabling platform 100 may be instrumented with a variety of sensors, gauges, detectors, etc. for measuring one or more operating parameters or conditions in or on the tieback enabling platform 100. Illustrative parameters include, but are not limited to, pressure, temperature, flow rates, efficiency, power usage, fluid levels, voltage, current, valve positions, etc. The control module 190 may include suitable processors, memory modules, and other information processing hardware to retrieve realtime and/or stored data and transmit this data to the remote command center 192. The remote command center 192 may be a vessel, the host facility, or an onshore Command Center. The signal communication may be performed via fiber optic, satellite, and RF connectivity. The remote command center 192 may transmit control signals to control operations of equipment at or near the tieback enabling platform 100.

The control module 190 may be configured to enable fully autonomous, semi-autonomous, and remotely controlled operation. By fully autonomous, it is meant that the control module 190 includes programs, applications, algorithms, and other control logics that can operate the tieback enabling platform 100 without any human intervention. By partially autonomous, it is meant that the control module 190 includes programs, applications, algorithms, and other control logics that can operate the tieback enabling platform 100 in conjunction with human inputs. Thus, generally under autonomous operation, at least some of the functions being performed on the tieback enabling platform 100 are done without human intervention and control. By remotely controlled operation, it is meant that human control over the functions being performed at the tieback enabling platform 100 is exerted from a location external to the tieback enabling platform 100.

The general utilities module 200 may include the equipment, controls and sensors for the various systems required to operate the tieback enabling platform 100. Illustrative equipment and systems include air-cooling system, marine systems (ballast, sea water etc.), and diesel fuel transfer. The general utilities module 200 may also include material handling systems, such as a pedestal crane, to support resupply, inspection, maintenance and repair operations.

Figure 4:
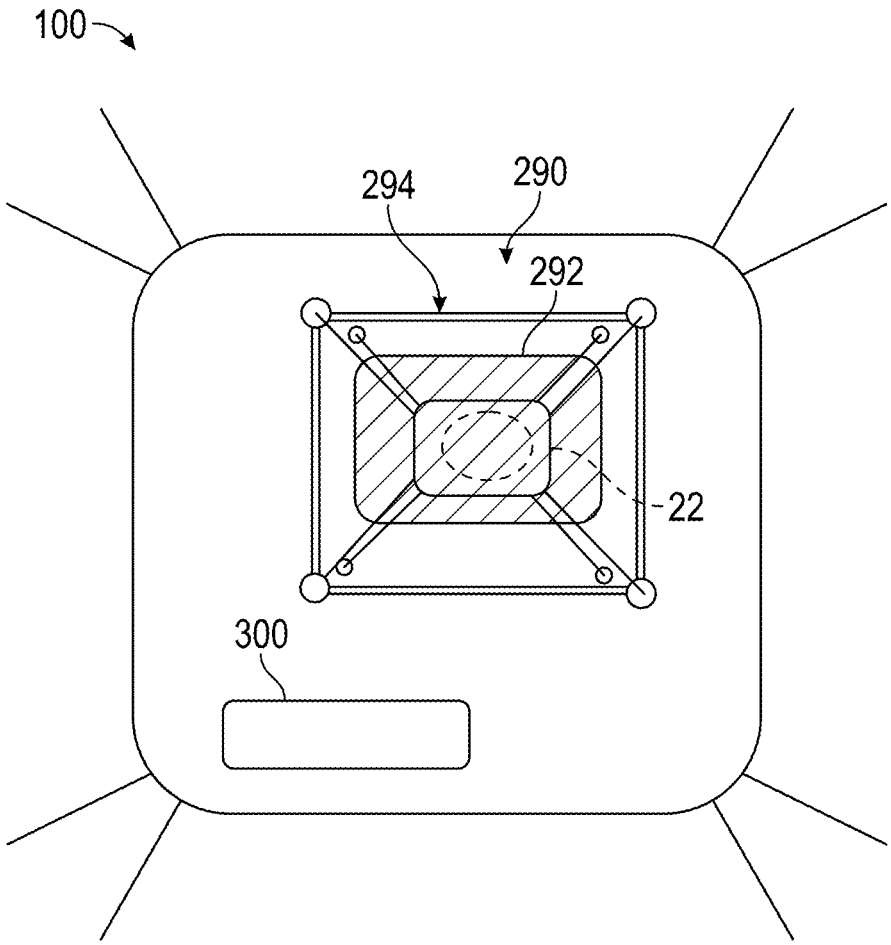
FIG. 4 schematically illustrates additional modules that may be used with tieback enabling embodiments of the present disclosure.

Referring to FIG. 4, in some embodiments, the tieback enabling platform 100 may include topsides equipment to accommodate light workover capability. For example, the tieback enabling platform 100 may include an intervention module 290, which in some embodiments may have a moonpool 292 and a light workover derrick 294 to perform downhole wireline intervention or coiled tubing operations on the producing subsea well 22. Thus, the need to mobilize a workover vessel or Mobile Offshore Drilling Unit (MODU) may be eliminated. The moonpool and derrick may also be used to run and retrieve downhole electric submersible pumps to boost flow, which may be used in lieu of subsea mudline booster pumps.

In embodiments, the tieback enabling platform 100 may include suitable equipment and systems to clean and treat produced water for disposal or reinjection. For instance, a water treatment module 300 configured to perform subsea separation may be deployed on the tieback enabling platform 100. The water treatment module 300 may be suited for dry gas developments as well as wet gas or condensate developments.

Referring now to FIG. 2, there is shown one embodiment of a support structure 120 according to the present disclosure. In one embodiment, the support structure 120 includes a hull 210 having four columns 212, a pair of pontoons 214, and two interconnecting horizontal tubular braces 216 positioned above the top of pontoons 214. The support structure 120 also includes a framework 220 and a deck 222. The framework 220 may be formed of orthogonal, truss-work of tubular and plate girder members 224 that rigidly connect the tops of the column 212. The deck 222 may be a flat, single deck structure that supports the topsides equipment discussed above, is flush with the top of columns 212, and provides a large (60 m×60 m) deck area with considerable flexibility for arranging and interconnecting various topsides modules and equipment skids. The resulting space frame provides the global structural strength to resist design static, wave and wave-induced dynamic loads, safely and efficiently.

In embodiments, the pontoons 214 may be configured to house diesel oil tanks or other fuel supplies. The pontoons 214 may be sized to provide sufficient capacity to permit 60 days of continuous operation of the diesel generators or other power producers, before resupply. The tieback enabling platform 100 will use ballast tanks in the pontoons that are mostly passive to submerge the platform to its operating draft. For example, four active ballast tanks may be used to maintain a constant operating draft during the filling and emptying cycles of diesel fuel or other material being loaded or offloaded from the tieback enabling platform 100.

Unmanned external and internal inspection of hull structure may be performed using suitable cameras and sensors distributed inside and outside of the tieback platform 100 as well as with remote operated vehicles, robots or drones.

Figure 3:
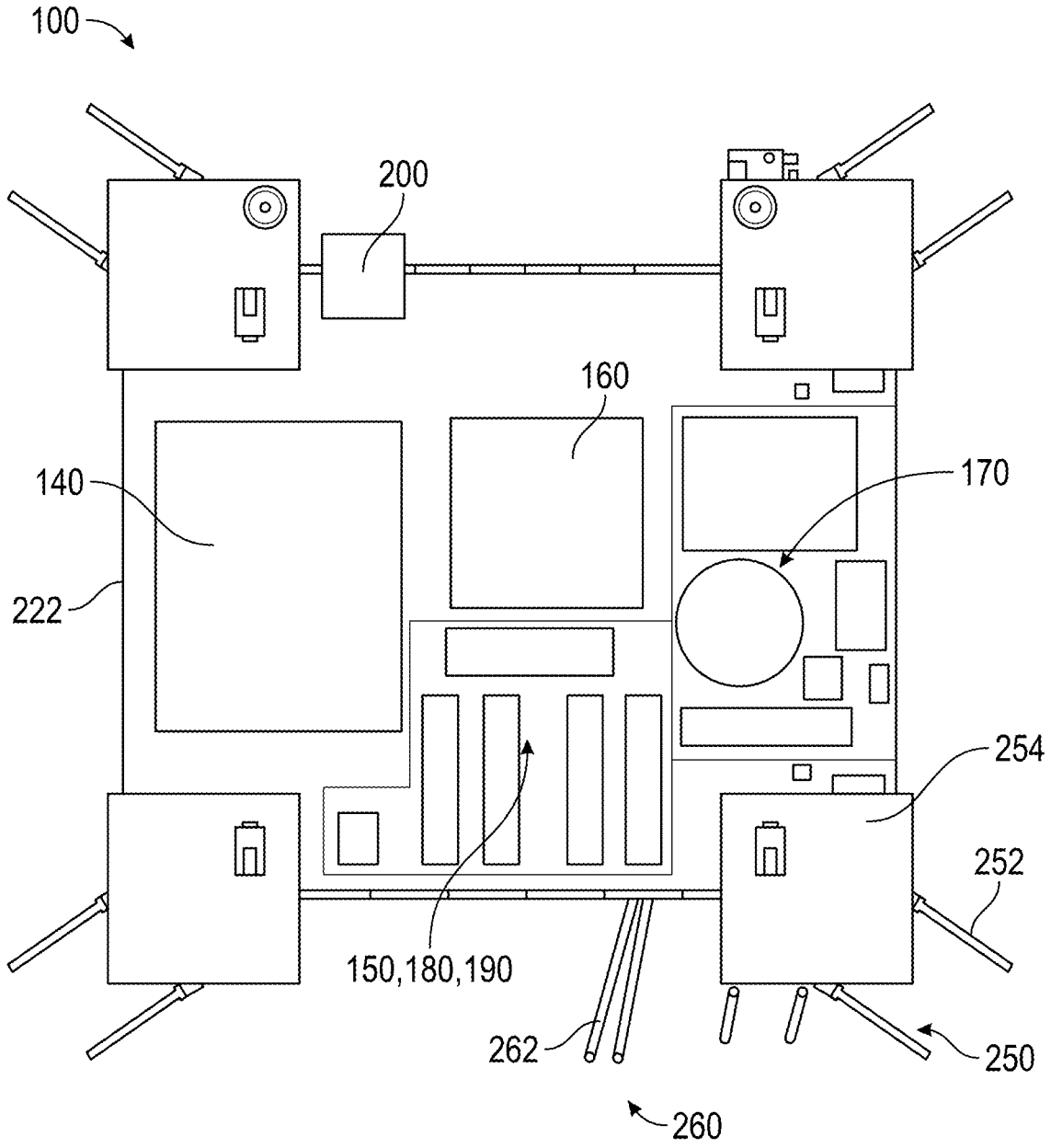
FIG. 3 depicts a top view of a tieback enabling platform according to one embodiment of the present disclosure.

Referring now to FIG. 3, the support structure 120 includes a mooring system 250 to moor the tieback enabling platform 100 to the seabed for the duration of its application. In embodiments, the mooring system 250 uses eight moorings 252 in an eight-point spread arrangement. The moorings 252 may be formed of a chain-polyester moorings with suction embedment anchors (not shown) in water depths ranging from 300 m to 3,000 m. The moorings 252 may be pre-set and hooked up to the tieback enabling platform 100 by suitably equipped anchor handling tug vessels (not shown). On the tieback enabling platform 100 are pocket chain fairleaders (not shown) and an inline tensioning system 254. In some embodiments, five pocket chain fairleaders are used and the tensioning system 254 does not require chain jacks and chain lockers. In some embodiments, the mooring system 250 may be passive. By passive, it is meant that the mooring system does not use energy consuming equipment to maintain station at a given location. For example, there is no equipment that uses hydraulic, pneumatic, electric, or chemical energy from a supply source (e.g., power line or batter) in order to operate as intended. In other embodiments, an active mooring system equipped with energy consuming equipment may be used to position the tieback enabling platform 100 within a desired area. Active mooring equipment may include positions sensors that determine a position, location, and/or orientation and active tensioners that pays out or retract lines to keep the tieback enabling platform 100 at a desired position, location, and/or orientation. Active positioning may be useful for workover activities to center the moonpool over the producing subsea well to be worked over.

The support structure 120 includes a riser system 260 having a plurality of risers 262; e.g., two to four dynamic riser umbilicals that provide control, chemicals and power to the producing subsea wells below. The risers 262 will be pulled into the tieback enabling platform 100 via I- or J-tubes (not shown) attached to the columns 212 (FIG. 2).

FIG. 3 illustrates one non-limiting arrangement of the topsides 110 for a tieback platform 100 according to the present disclosure. The systems, supplies, and components making up the topsides 110 may be arranged on the deck 222. One illustrative, but not limiting, embodiment of a topsides 110 may include a power generation module 140, a switchgear module 150, a chemical injection module 160, a water injection module 170, a subsea control module 180, a control module 190, and a general utility module 200.

Referring to FIGS. 1 and 3, for water injection activities, one or more of the risers 262 may be pulled into an I-tube (not shown) on the column 212 (FIG. 2) or riser porch (not shown) on the pontoon 214 (FIG. 2) to convey treated water to the water injection wells 264.

While the foregoing is directed to embodiments of the present disclosure, other and further embodiments of the disclosure may be devised without departing from the basic scope thereof, and the scope thereof is determined by the claims that follow.

What is claimed is:

1. A system for conveying a fluid produced from at least one producing subsea well to an existing host facility within a 100 km distance via a flowline, comprising:

a support structure having at least:

interconnected pontoons supporting two or more columns, the interconnected pontoons comprising one or more ballast tanks configured to submerge at least a portion of the support structure, a framework connecting a top portion of the two or more columns, a mooring system anchoring the support structure to a seabed and configured to passively position the support structure proximate to the at least one producing subsea well, and a deck, the support structure being configured to elevate the deck above a water's surface when in operation; and a plurality of topsides modules disposed on the deck, the plurality of topsides modules including at least:

a power generation module configured to generate 20 MW of electrical power, a switchgear module configured to boost fluid flow from at least one fluid mover, at least one flow control device, and at least one thermal unit, a flowline heating module configured to energize a heating unit associated with the flowline;

a chemical injection module configured to add at least one additive to the fluid produced from the at least one producing subsea well, a water injection module configured to treat, compress, and inject seawater to one or more injection subsea wells intersecting a reservoir associated with the at least one producing subsea well, a subsea control module configured to control at least one subsea well device, and a control module configured to communicate with a remote command center.

2. The system of claim 1, wherein the plurality of topsides modules further includes an intervention module, the intervention module including at least one moonpool, derrick and equipment providing access and egress to the at least one producing subsea well.

3. The system of claim 1, wherein the plurality of topsides modules further includes a module configured to clean and treat produced water.

4. The system of claim 1, wherein the control module is configured for autonomous operation.

5. The system of claim 1, wherein the control module is configured to be operated remotely.

6. The system of claim 1, wherein the system is configured to be periodically resupplied with at least one of: (i) a fuel for the power generation module, and (ii) the at least one additive for the chemical injection module.

7. The system of claim 1, wherein the support structure is configured for access by vessels for periodic inspection.

8. The system of claim 1, wherein the subsea control module is configured to control instrumentation and sensors.

9. The system of claim 1, the support structure comprising a pair of pontoons.

10. The system of claim 1, the support structure comprising a brace interconnecting the pontoons.

11. The system of claim 1, the two or more columns comprise four columns.

12. The system of claim 11, the support structure further comprising a framework connecting a top portion of the four columns.

13. A method for conveying a fluid produced from at least one producing subsea well to an existing host facility within a 100 km distance via a flowline, comprising:

(a) positioning a support structure at a water's surface and proximate to the at least one producing subsea well, the support structure having at least:

interconnected pontoons supporting two or more columns, the interconnected pontoons comprising one or more ballast tanks configured to submerge at least a portion of the support structure, a framework connecting a top portion of the two or more columns, a mooring system anchoring the support structure to a seabed and configured to passively position the support structure proximate to the at least one producing subsea well, and a deck, the support structure being configured to elevate the deck above a water's surface when in operation; and a plurality of topsides modules disposed on the deck, the plurality of topsides modules including at least:

a power generation module configured to generate 20 MW of electrical power, a switchgear module configured to boost the flow from at least one fluid mover, at least one flow control device, and at least one thermal unit, a flowline heating module configured to energize a heating unit associated with the flowline;

a chemical injection module configured to add at least one additive to the fluid produced from the at least one producing subsea well, a water injection module configured to treat, compress and inject seawater to at least one injection wells to improve ultimate resource recovery from the reservoir, a subsea control module configured to control at least one subsea well device, and a control module configured to communicate with a remote command center;

(b) heating the produced fluid in the flowline using at least the power generation module, the flow line heating module, and the switchgear module;

(c) injecting the at least one additive into the at least one subsea well using the chemical injection module;

(d) treating, compressing, and injecting seawater into the at least one injection wells using the water injection module;

(e) controlling at least one subsea well device using the subsea control module;

(f) communicating with the remote command center using the control module; and (g) conveying the produced fluid to the existing host facility.

14. The method of claim 13, further comprising: cleaning and treating produced water using a cleaning and treating module of the plurality of topsides modules.

15. The method of claim 13, wherein the support structure and the plurality of topsides modules disposed on the deck are part of a platform and further comprising autonomously operating the platform.

16. The method of claim 13, wherein the support structure and the plurality of topsides modules disposed on the deck are part of a platform and further comprising remotely operating the platform.

17. The method of claim 13, wherein the support structure and the plurality of topsides modules disposed on the deck are part of a platform and further comprising resupplying the platform with at least one of: (i) a fuel for the power generation module, and (ii) the at least one additive for the chemical injection module.

18. The method of claim 13, further comprising configuring the subsea control module to remotely monitor control instrumentation and sensors.

19. A system for producing a fluid from the at least one producing subsea well, comprising:

(a) an existing host facility configured to process the fluid produced from the at least one producing subsea well;

(b) a subsea tieback connecting the host facility to the at least one producing subsea well;

(c) a support structure having at least:

interconnected pontoons supporting two or more columns, the interconnected pontoons comprising one or more ballast tanks configured to submerge at least a portion of the support structure, a framework connecting a top portion of the two or more columns, a mooring system anchoring the support structure to a seabed and configured to position the support structure proximate to the at least one producing subsea well, and a deck, the support structure being configured to position the deck above a water's surface when in operation; and (d) a plurality of topsides modules disposed on the deck, the plurality of topsides modules including at least:

a power generation module configured to generate 20 MW of electrical power, a switchgear module configured to control at least one fluid mover, at least one flow control device, and at least one thermal unit, a flowline heating module configured to energize a heating unit associated with the flowline;

a chemical injection module configured to add at least one additive to the fluid produced from the at least one producing subsea well, water injection module configured to treat, compress and inject seawater to improve reservoir ultimate recovery, a subsea control module configured to control at least one subsea well device, and a control module configured to communicate with a remote command center to enable the support structure to be normally unmanned.

20. The system of claim 19, the two or more columns comprising four columns and wherein the framework connects a top portion of the four columns.

* * * * *